United States Patent [19]

Kawase et al.

[11] Patent Number: 4,870,229

[45] Date of Patent: Sep. 26, 1989

[54] PUSH-BUTTON SWITCH WITH UNLOCKING PREVENTION ASSEMBLY

[75] Inventors: Toshihiro Kawase; Sachiya Sano, both of Aichi, Japan

[73] Assignee: Kabushiki Kaisha Tokai Rika Denki Seisakusho, Aichi, Japan

[21] Appl. No.: 276,760

[22] Filed: Nov. 28, 1988

[30] Foreign Application Priority Data

Dec. 21, 1987 [JP] Japan ..... 62-193849[U]

[51] Int. Cl.[4] ..... H01H 9/20; H01H 13/56

[52] U.S. Cl. ..... 200/5 B; 200/5 F; 200/524

[58] Field of Search ..... 200/5 R, 5 B, 5 C, 50 C, 200/523, 524, 525

[56] References Cited

U.S. PATENT DOCUMENTS 3,934,101 1/1976 Jones ..... 200/5 B 4,575,590 3/1986 Hattori et al. ..... 200/5 B 4,795,860 1/1989 Kamada et al. ..... 200/5 B

*Primary Examiner*—J. R. Scott

*Attorney, Agent, or Firm*—Finnegan, Henderson, Farabow, Garrett, & Dunner

[57] ABSTRACT

A switch device including a first switch, a first push-button assembly having a push surface and disposed to alternately turn on and off the first switch in response to a push force, a first spring for urging the first push-button assembly in a direction opposite the push force, a locking device including a spring and a cam for locking said first push-button assembly in a pushed-in position, a second switch, a second push-button assembly having a push surface and disposed to turn on the second switch-in response to a push force, a second spring for urging the second push-button assembly in a direction opposite the second push force, and a lug for preventing the locking device from unlocking in response to an inadvertent push force.

10 Claims, 3 Drawing Sheets

PUSH-BUTTON SWITCH WITH UNLOCKING PREVENTION ASSEMBLY

BACKGROUND OF THE INVENTION

1. Field of the Invention

The present invention relates to a switch device in which two switches are manipulated by two push-buttons, and the push surface of one of the push-buttons extends through an opening in the push-surface of the other button.

2. Description of the Prior Art

A conventional switch device of the type described above was disclosed in Japanese Utility Model Application (OPI) No. 153040/81. In this type of switch device, a first push-button is urged in a direction opposite to the pushing force by a helical spring. A push locking mechanism acts to hold the button in a pushed-down position after a first push and to release the button in response to a second push. A second push-button projects through an opening in the first push-button and is urged in a direction opposite to the pushing force by a second helical spring. A switch corresponding to each of the push-buttons is disposed within the switch device, each of which is operated by pushing the respective button.

An inherent problem with prior art devices is that when the second button is pushed after the first button is already in the pushed-in position, the first button is likely to be pushed by mistake, releasing the first button.

SUMMARY OF THE INVENTION

An object of the present invention is to resolve the above-mentioned problem by providing an improved switch device.

This and other objects are accomplished by a switch device comprising a first switch, a first push-button assembly having a push-surface and disposed to alternately turn on and off said switch in response to a push force, first urging means for urging said first push-button assembly in a direction opposite said push force, locking means for locking said first push-button assembly in a pushed-in position, a second switch, a second push-button assembly having a push-surface and disposed to turn on said second switch in response to a push force, second urging means for urging said push-button assembly in a direction opposite said second push force, and preventing means for preventing said locking means from unlocking in response to an inadvertant push-force.

BRIEF DESCRIPTION OF THE DRAWINGS

The accompanying drawings, which are incorporated in and constituted a part of the specification, illustrate one embodiment of the invention, and together with the description, serve to explain the principles of the invention.

DETAILED DESCRIPTION OF THE PREFERRED EMBODIMENT

Figure 1:
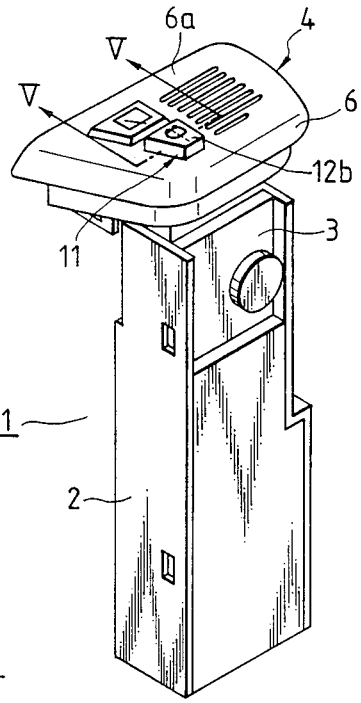
FIG. 1 is a perspective view of an embodiment of a switch device in accordance with the present invention.
Figure 4:
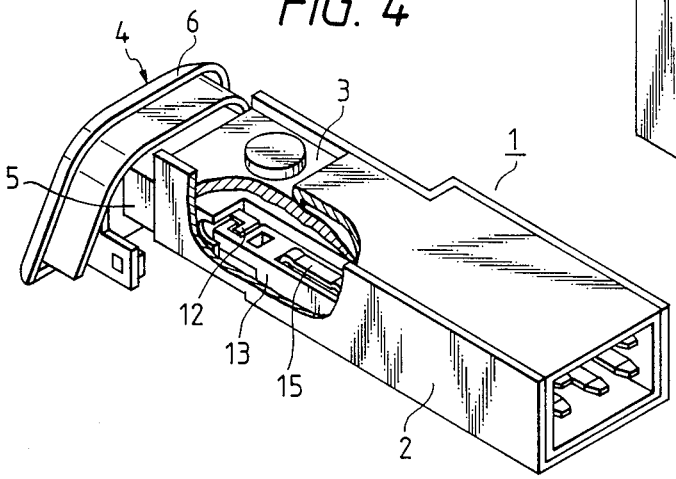
FIG. 4 is a cutaway perspective view of the switch device of FIG. 1.

Reference will now be made in detail to the present preferred embodiment of the invention, examples of which are illustrated in the accompanying drawings.

The switch device comprises a box-shaped body 1, a first push-button assembly 4, compressed helical springs 7 and 14, movable contacts 9 and 15, a second push-button assembly 11, a locking pin 17, and a cam 18. The box-shaped body 1 is composed of a case 2 having a substantially U-shaped cross-section. First push-button assembly 4 is movable relative to the case 2 and includes a push-button shaft 5 extending through an opening in the top of the case 2, and a button portion 6 having a relatively large surface area and formed on the top of the push-button shaft 5.

Figure 2:
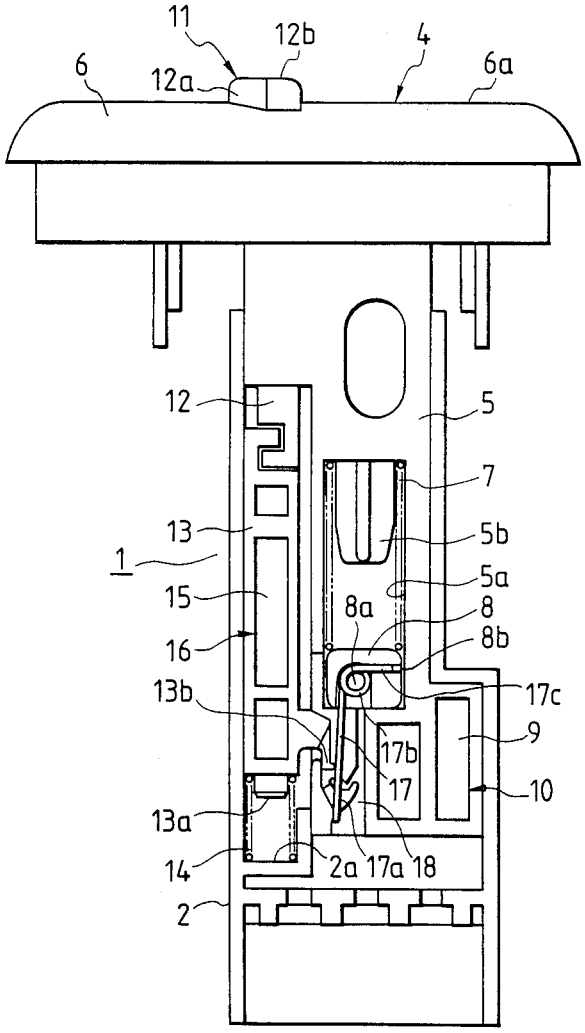
FIG. 2 is a longitudinal cross-sectional front view of the switching device of FIG. 1.
Figure 3:
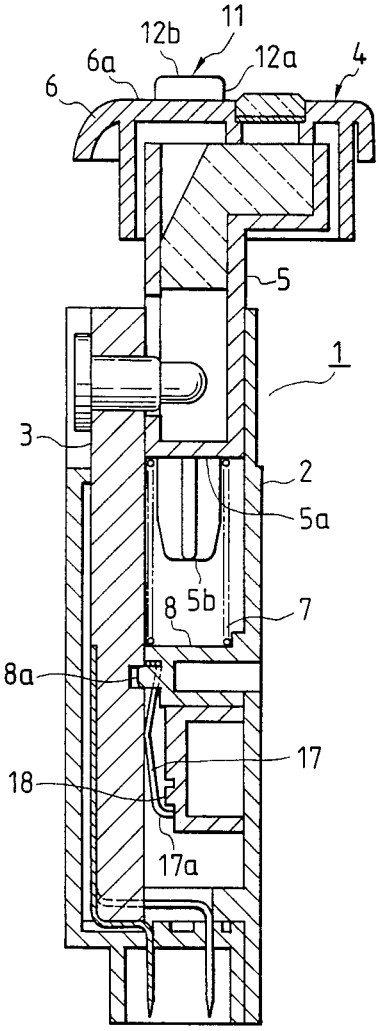
FIG. 3 is a longitudinal cross-sectional side view of the switch device of FIG. 1.

A compressed helical spring 7 is provided in the rectangular opening **5*a* of the push-button shaft 5 and is held in place by a support boss 5*b* that extends down from the top of the opening 5*a* and is fitted in to the spring 7. A spring support 8 is provided at the bottom of the rectangular opening 5*a* beneath the spring 7. The compressed helical spring 7 urges the first push-button assembly 4 in an upward direction opposite the push force. A movable contact 9 is provided on the first push-button assembly 4 and is disposed to contact a fixed contact (not shown) provided on the inside surface of the case cover 3. These contacts constitute a first switch 10, that is activated depending on the position of the first push-botton assembly 4. When the first push-button assembly 4 is in a protruding position as shown in FIG. 2, the first switch 10 is turned off. When the first push-button assembly 4 is pushed-in, the switch 10** is turned on.

The second push-button assembly 11 is composed of a push-button shaft 12 and a contact support shaft 13 engaged therewith. The push-button shaft 12 has a push-button portion **12*a* that extends through an opening in the first push-surface 6*a* so that a push-surface 12*b* of the second push-button assembly 11 projects over the push-surface 6*a* of the first push-button 6. A compressed helical spring 14 is provided between the bottom of the contact support shaft 13 and a shelf 2*a* formed within the case 2. A boss 13*a*, formed on the bottom of the contact support shaft 13, is fitted in the spring 14 to support it. The compressed helical spring 14 urges the second push-button assembly 11** in an upward direction opposite the push force.

A movable contact 15 is provided on the contact support shaft 13 so as to contact a fixed contact (not shown) provided on the inside surface of the case cover 3. These contacts constitute a second switch 16, that is actuated depending upon the position of the second push-button assembly 11. When the second push-button assembly 11 is in a protruding position as shown in FIG. 2, the switch 16 is turned off. When the push-button 11 is pushed-in, the switch 16 is turned on.

The switch device also includes a locking pin 17 that is made of spring wire and includes a locking portion **17*a* having a bent tip, a helical torsion spring portion 17*b*, and an engaging portion 17*c*. The spring support 8 has a groove 8*b* adapted to receive the engaging portion 17*c* of the locking pin 17. The boss 8 also has a spring support portion 8a adapted to support the helical torsion spring portion 17b of the locking pin 17**.

Figure 6:
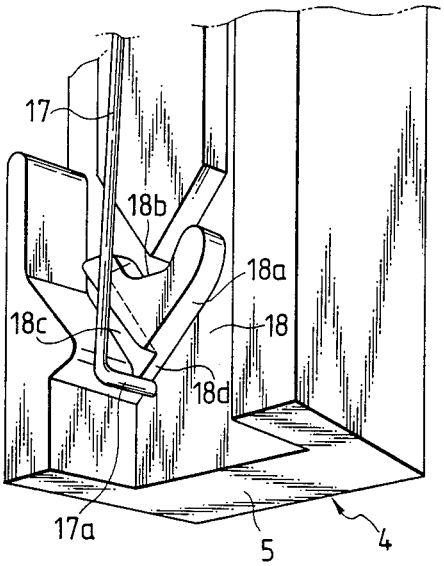
FIG. 6 is a perspective view of the cam of the switch device.
Figure 7A:
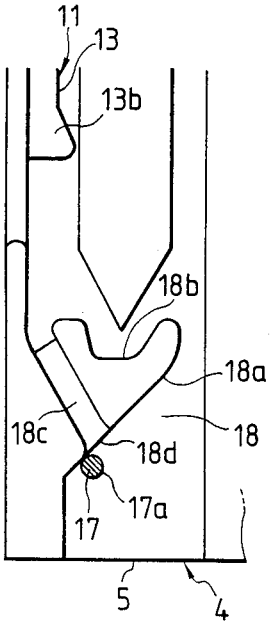
FIGS. 7(*a*), 7(*b*), and 7(*c*) are schematic diagrams showing the operation of the cam and the locking pin.
Figure 7B:
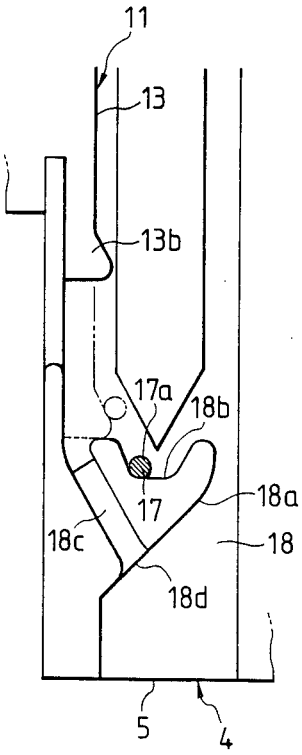
Figure 7C:
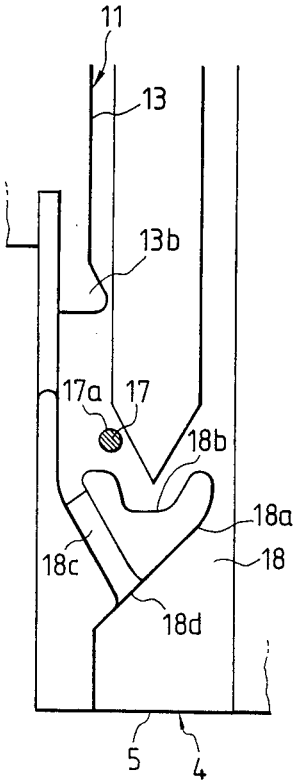

As shown in FIG. 6, a heart-shaped cam 18 is disposed at the lower end of the first push-button assembly 4, to engage the locking portion 17a of the locking pin 17. The spring force of the locking pin 17 urges the locking portion 17a leftward. Every time the first push-button assembly 4 is pushed, the cam 18 is moved in a downward direction relative to the locking portion 17a of the locking pin 17 as shown in FIGS. 7(*a*), 7(*b*) and 7(*c*). When the cam 18 and the locking portion 17a are in the position shown in FIG. 7(*b*), the first push-button assembly 4 is locked in the pushed-in position. When the cam 18 and the locking portion 17a are in the position shown in FIG. 7(*a*), the push-button assembly 4 is in a protruding position. The push-button assembly 4 is alternately locked and released every time the push-button is pressed.

Figure 5:
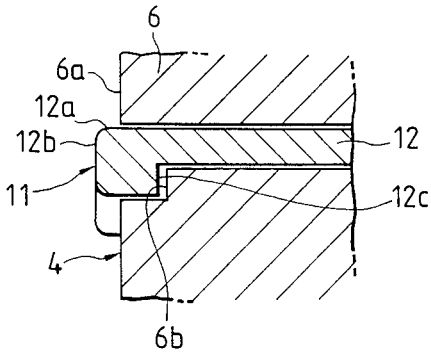
FIG. 5 shows a cross-sectional view of the switch device along a section line V—V shown of FIG. 1.

As depicted in FIG. 5, the push-button portion 12a of the push shaft 12 has button 12c. When the second push-button assembly 11 is depressed, the bottom 12c of the push-botton portion 12a is engaged with the step 6b of the first push-button assembly 4. Therefore, depressing the second push-button assembly 11 also depresses the first push-button assembly 6. As depicted in FIG. 2, the contact support shaft 13 and the push-button shaft 12 are connected at their upper and lower portions, respectively. Contact support shaft 13 has a preventive lug 13b disposed to selectively block cam groove 18c. When the second push-button assembly 11 is depressed while the first push-button assembly 4 is in the locked position, the preventive lug 13b blocks the cam groove 18c depicted by a dotted line in FIG. 7(*b*). This prevents the locking portion 17a of the locking pin 17 from entering the cam groove 18c, and therefore prevents the push-button assembly from being released from the pushed-in position.

The following is a description of the operation of the switch device described above. When the first and the second push-button assemblies 4 and 11 are both in their protruded positions and the first push-button assembly 4 is then depressed, the cam 18 of the first push-button assembly 4 is moved downward. This causes the locking portion 17a of the locking pin 17 to move relative to the cam 18. The locking portion 17a is moved along slope 18a, from a position shown in FIG. 7(*a*), to a position shown in FIG. 7(*b*) so that the locking portion 17a is moved into the notch 18b of the cam 18. Since locking pin 17 is urged to the left side of the notch as shown in FIG. 7b, even when the push force is removed from the push-button assembly 4, the assembly 4 is locked in the pushed-in position. When the push-button assembly 4 is depressed a second time, the cam 18 is moved from the locked position shown in FIG. 7(*b*) to the released position shown in FIG. 7(*c*) and finally to the unlocked position as shown in FIG. 7(*a*). As shown in FIG. 7(*c*), when the push-button assembly 4 is depressed a second time the locking portion 17a of the locking pin 17 goes out of the notch 18b of the cam 18, so that the cam 18 and the locking pin 17 are disengaged from each other. When the push-button assembly 4 is then released, the cam 18 is moved upward by the pressure of helical spring 7, and the locking portion 17a of the pin 17 passes through the cam groove 18c. The locking portion 17a is thereby returned to the bottom portion 18d of cam 18 as shown in FIGS. 6 and 7a. Consequently, the first push-button assembly 4 is returned to the protruded position and the first switch 10 is turned off. The first push-button assembly 4 is thereby alternately locked and unlocked every time the button is depressed.

As described earlier, when the first push-button assembly 4 is in the protruded position and the second push-button assembly 11 is pushed, the bottom 12c of the push-button portion 12a is engaged with the step 6b of the first push-button assembly 4, so that both the push-buttons are moved together in a downward direction.

When both push-button assemblies 4 and 11 are moved to the pushed-in positions, the first and the second switches 10 and 16 are turned on. However, when the second push-button 12b is released, the first push-button assembly 4 remains locked in the pushed-in position and the second push-button assembly 11 is returned to the protruded position by the force of the compressed helical spring 14. As a result, the first switch 10 remains turned on, and the second switch 16 is turned off.

When the second push-button assembly 11 is pushed while the first push-button assembly 4 remains locked in the pushed-in position, the second switch 16 is turned on and the first switch remains on. When the second push-button assembly 11 is depressed, the lug 13b of the contact support portion 13 blocks the cam groove 18c as shown by the dotted line in FIG. 7(*b*). This assures that even if the first push-button assembly 4 is accidentally pushed together with the second push-button assembly 11, locking portion 17a of the locking pin 17 is prevented from entering groove 18c and therefore remains in the locked position. When pressure is removed from the second push-button assembly 11, the first push-button assembly 4 remains locked in the pushed-in position, and the second push-button assembly 11 returns to the protruded position.

What is claimed is:

1. A switch device comprising:

a first switch;

a first push-botton assembly having a first push-surface and disposed to move said first switch between a first switch first position and a first switch second position to alternately turn on and off said first switch in response to a push force applied to said first push-surface;

first urging means for urging said first push-button assembly in a direction opposite said push force applied to said first push-surface;

locking means for locking said first push-button assembly in a pushed-in position corresponding to said first switch first position and for unlocking said first push-button assembly to enable said switch to be moved from said first switch first position to said first switch second position in response to the application of said push force on said first push-surface when said first switch is in said first switch first position;

a second switch;

a second push-button assembly having a second push-surface and disposed to move said second switch between a second switch first position and a second switch second position in response to a push force applied to said second push-surface;

second urging means for urging said second push-button assembly in a direction opposite said push force applied to said second push-surface; and preventing means extending from and moveable with said second push-button assembly for preventing said locking means from unlocking said first push-button assembly in response to the application of said push force to said first push surface during application of said push force to said second push surface.

2. A switch device as set forth in claim 1, wherein said locking means includes a locking pin and a cam including a first cam surface having a notch area, said cam surface disposed to move relative to said locking pin in response to the application of said first push force when said first push-button assembly is in said first switch second position to move said locking pin into said notch area.

3. A switch device as set forth in claim 2, wherein said preventing means includes a lug disposed on said second push-button assembly to block said locking pin from leaving said notch area.

4. A switch device as set forth in claim 1, wherein each of said first and second urging means is a helical spring.

5. A switch device as set forth in claim 1, wherein said second push-button assembly includes engaging means for engaging said first push-button assembly to move said first push-button assembly in unison with said second push-button assembly in response to the application of a push force upon said second push-surface.

6. A switch device as set forth in claim 5, wherein said first push-button assembly includes a step portion and said engaging means includes a surface disposed to engage said step portion.

7. A switch device as set forth in claim 1, wherein said first push-surface includes an opening and said second push-surface extends through said opening.

8. A switch device as set forth in claim 2, wherein said cam includes a second cam surface for guiding said lock pin in response to the application of a push force applied to said first push-surface when said first switch is in said first switch first position such that said lock pin moves from said notch area to enable said first switch to move from said first switch first position to said first switch second position.

9. A switch device as set forth in claim 8, wherein said cam is substantially heart-shaped.

10. A switch as set forth in claim 8, wherein said lock pin comprises a resilient member.

* * * * *